US010066555B2

(12) United States Patent
Opdenbosch et al.

(10) Patent No.: US 10,066,555 B2
(45) Date of Patent: Sep. 4, 2018

(54) HYDRAULIC SYSTEM AND METHOD FOR CONTROLLING SAME

(71) Applicant: Caterpillar Forest Products Inc., Peoria, IL (US)

(72) Inventors: Patrick Opdenbosch, Newnan, GA (US); Joseph R. Storey, Newnan, GA (US)

(73) Assignee: Caterpillar Forest Products Inc., Peoria, IL (US)

( * ) Notice: Subject to any disclaimer, the term of this patent is extended or adjusted under 35 U.S.C. 154(b) by 750 days.

(21) Appl. No.: 14/672,411

(22) Filed: Mar. 30, 2015

(65) Prior Publication Data

US 2016/0290369 A1 Oct. 6, 2016

(51) Int. Cl.

*F02D 29/04* (2006.01)
*F15B 11/042* (2006.01)
*E02F 9/22* (2006.01)

(52) U.S. Cl.

CPC ..... *F02D 29/04* (2013.01); *F15B 11/0423* (2013.01); *E02F 9/2246* (2013.01); *E02F 9/2296* (2013.01); *F15B 2211/20523* (2013.01); *F15B 2211/20546* (2013.01); *F15B 2211/633* (2013.01); *F15B 2211/6309* (2013.01); *F15B 2211/6343* (2013.01); *F15B 2211/6346* (2013.01); *F15B 2211/6651* (2013.01); *F15B 2211/6652* (2013.01); *F15B 2211/6656* (2013.01); *F15B 2211/6657* (2013.01)

(58) Field of Classification Search

None

See application file for complete search history.

(56) References Cited

U.S. PATENT DOCUMENTS 4,523,892 A * 6/1985 Mitchell ..... B60W 10/06 417/218
4,704,866 A * 11/1987 Myers ..... F16H 61/435 180/306
4,763,473 A 8/1988 Ziplies et al.
5,468,126 A * 11/1995 Lukich ..... F02D 29/04 123/383
5,737,993 A 4/1998 Cobo et al.
5,951,258 A 9/1999 Leuschow et al.
6,241,263 B1 6/2001 Hicks
7,165,397 B2 1/2007 Raszga et al.
7,484,814 B2 2/2009 Dombach
8,818,662 B2 8/2014 Welschof et al.
2011/0264335 A1 10/2011 Zhao et al.

(Continued)

*Primary Examiner* — Thomas E Lazo
*Assistant Examiner* — Michael Quandt
(74) *Attorney, Agent, or Firm* — Hibshman Claim Construction PLLC

(57) ABSTRACT

A hydraulic system includes an engine; at least one hydraulic pump operatively coupled to the engine for transfer of mechanical power therebetween; and a controller operatively coupled to the engine and the at least one hydraulic pump. The controller is configured to determine a lug speed error as a difference between a target lug speed value and a speed of the engine, set at least one closed-loop gain to zero when the speed of the engine is greater than or equal to the target lug speed value, set the at least one closed-loop gain to a non-zero value when the speed of the engine is less than the target lug speed value, generate a pump control signal by scaling the lug speed error by the at least one closed-loop gain.

17 Claims, 9 Drawing Sheets

(56) References Cited

U.S. PATENT DOCUMENTS

| | | | |
|---|---|---|---|
| 2014/0053801 | A1 | 2/2014 | Frelich |
| 2014/0083392 | A1 | 3/2014 | Cattani et al. |
| 2014/0083393 | A1 | 3/2014 | Cattani et al. |
| 2014/0297158 | A1 | 10/2014 | Baroni et al. |
| 2015/0016886 | A1 | 1/2015 | Frelich |

* cited by examiner

HYDRAULIC SYSTEM AND METHOD FOR CONTROLLING SAME

TECHNICAL FIELD

This patent disclosure relates generally to apparatus and methods for controlling a hydraulic pump system and, more particularly, to apparatus and methods for controlling a power system including an engine operatively coupled to a hydraulic pump system.

BACKGROUND

Hydraulic systems are known for converting shaft mechanical power into fluid mechanical power via hydraulic pumps. The fluid mechanical power may be used to actuate hydraulic actuators such as linear hydraulic cylinders or rotary hydraulic motors, to perform work against a load. Shaft power for operating a hydraulic system may be provided by a combustion engine that is configured to convert chemical energy, stored in a fuel, into shaft mechanical power.

Variable displacement hydraulic pumps are known in the art. A swashplate actuator may be used to vary the volumetric flow rate of a variable displacement pump, even at a constant operating speed of the variable displacement pump. The swashplate actuator may be fluidly coupled to a hydraulic fluid outlet of the variable displacement pump, such that increasing discharge pressure at the outlet of the variable displacement pump may act to decrease the displacement, and therefore volumetric flow rate, of the variable displacement pump.

U.S. Pat. No. 7,165,397 (the '397 patent), entitled "Anti-Stall Pilot Pressure Control System for Open Center Systems," purports to address the problem of engine stall caused by excessive hydraulic pump load applied to an engine by a hydraulic pump. The '397 patent describes a hydraulic system including an engine coupled to a main hydraulic pump and a fixed-displacement pilot pressure pump. The pilot pressure pump of the '397 patent is fluidly coupled to an anti-stall valve via an orifice.

If the demanded hydraulic power exceeds the available engine power, the torque demands of the main pump will slow the engine of the '397 patent. The decrease in engine speed decreases the pilot flow produced by the pump, and thus decreases the pressure drop across the orifice. When this differential pressure is no longer large enough to overcome the bias of an actuator spring, the anti-stall valve will switch to its at-rest position. In this position, all pilot pump flow is directed to a tank through a relief valve, and the pressure in the downstream pilot control circuits is also dumped to the tank. When the engine speed recovers sufficiently, the increased pilot flow through the orifice returns the anti-stall valve to an open position thereby restoring pilot fluid pressure to the downstream pilot control circuits.

However, the hydraulic circuit proposed by the '397 patent is complex and potentially expensive. Further, total removal of hydraulic load resulting from operation of the anti-stall valve of the '397 patent may result in jerky operation of implements and operator frustration. Accordingly, there is a need for improved hydraulic systems and methods to address the aforementioned problems and/or other problems known in the art.

It will be appreciated that this background description has been created to aid the reader, and is not to be taken as a concession that any of the indicated problems were themselves known in the art.

SUMMARY

According to an aspect of the disclosure, a hydraulic system comprises an engine, at least one hydraulic pump operatively coupled to the engine for transfer of mechanical power therebetween, and a controller operatively coupled to the engine and the at least one hydraulic pump. The controller is configured to determine a lug speed error as a difference between a target lug speed value and a speed of the engine, set at least one closed-loop gain to zero when the speed of the engine is greater than or equal to the target lug speed value, set the at least one closed-loop gain to a non-zero value when the speed of the engine is less than the target lug speed value, generate a pump control signal by scaling the lug speed error by the at least one closed-loop gain, and transmit the pump control signal to the at least one hydraulic pump for controlling a load applied to the engine by the at least one hydraulic pump.

According to another aspect of the disclosure, a method for controlling a hydraulic system comprises transmitting mechanical power from an engine to at least one hydraulic pump, determining a lug speed error as a difference between a target lug speed value and a speed of the engine, setting at least one closed-loop gain to zero when the speed of the engine is greater than or equal to the target lug speed value, setting the at least one closed-loop gain to a non-zero value when the speed of the engine is less than the target lug speed value, generating a pump control signal by scaling the lug speed error by the at least one closed-loop gain, and transmitting the pump control signal to the at least one hydraulic pump for controlling a load applied to the engine by the at least one hydraulic pump.

According to another aspect of the disclosure, an article of manufacture comprises non-transient machine-readable instructions encoded thereon for causing a processor to control a hydraulic system by performing process steps, the process steps including determining a lug speed error as a difference between a target lug speed value and a speed of an engine, setting at least one closed-loop gain to zero when the speed of the engine is greater than or equal to the target lug speed value, setting the at least one closed-loop gain to a non-zero value when the speed of the engine is less than the target lug speed value, generating a pump control signal by scaling the lug speed error by the at least one closed-loop gain, and transmitting the pump control signal to at least one hydraulic pump for controlling a load applied to the engine by the at least one hydraulic pump.

DETAILED DESCRIPTION

Aspects of the disclosure will now be described in detail with reference to the drawings, wherein like reference numbers refer to like elements throughout, unless specified otherwise.

Figure 1:
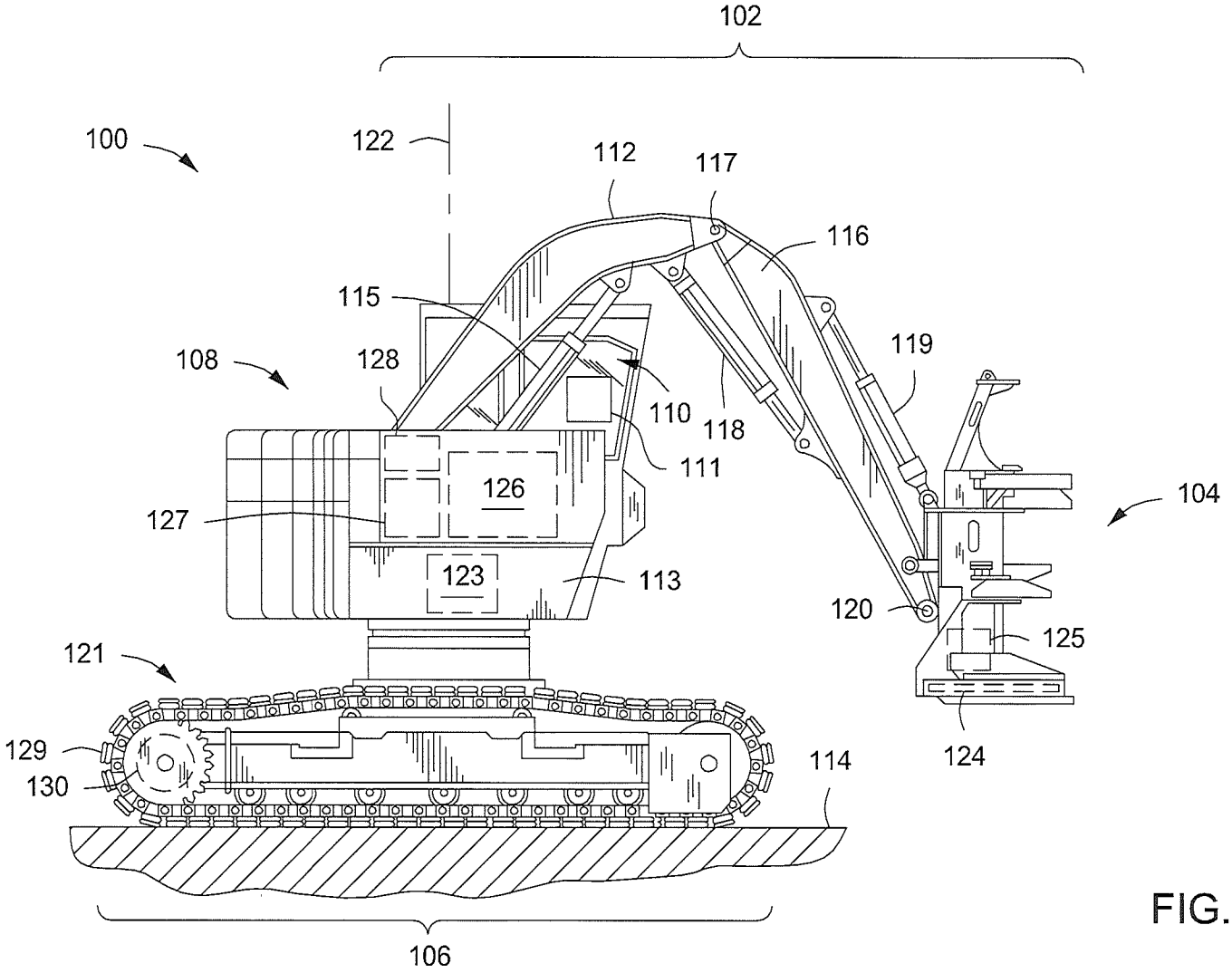
FIG. 1 is a side view of a machine, according to an aspect of the disclosure.

FIG. 1 is a side view of a machine 100, according to an aspect of the disclosure. The machine 100 may embody a fixed or mobile machine that performs some type of operation associated with an industry such as mining, construction, forming, forestry, transportation, or another industry known in the art. For example, the machine 100 may be a forest machine; a feller-buncher; a harvester; an earth moving machine such as an excavator, a dozer, a loader, a backhoe, a motor grader, or a dump truck; or any other work machine known in the art. The exemplary machine 100 illustrated in FIG. 1 is a track feller-buncher.

The machine 100 may include an implement system 102 configured to move a work tool 104, a travel system 106 for propelling the machine 100, a power system 108 that provides power to the implement system 102 and the travel system 106, and an operator station 110 that may include control interface devices 111 for local or remote control of the implement system 102, the travel system 106, the power system 108, or combinations thereof. The power system 108 may be operatively coupled to the travel system 106, the implement system 102, or both, for transmission of mechanical power therebetween.

The power system 108 may include an engine 126 and a hydraulic pump assembly 127. The engine 126 may be a reciprocating internal combustion engine, such as a compression ignition engine or a spark ignition engine, a rotating internal combustion engine, such as a gas turbine, combinations thereof, or any other source of mechanical power known in the art. The hydraulic pump assembly 127 may include one or more hydraulic pumps, and may be operatively coupled to the engine 126 for transmission of mechanical power therebetween.

The implement system 102 may include a linkage structure coupled to hydraulic actuators, which may include linear or rotary actuators, to move the work tool 104. For example, the implement system 102 may include a boom 112 that is pivotally coupled to a frame 113 of the machine 100 about a first axis (not shown) that is oriented horizontally with respect to the work surface 114, and actuated by one or more double-acting, boom hydraulic cylinders 115 (only one shown in FIG. 1). The implement system 102 may also include a stick 116 that is pivotally coupled to the boom 112 about a second axis 117 that is oriented horizontally with respect to the work surface 114, and actuated by a double-acting, stick hydraulic cylinder 118.

The implement system 102 may further include a double-acting, tool hydraulic cylinder 119 that is operatively coupled between the stick 116 and the work tool 104 to pivot the work tool 104 about a third horizontal axis 120. The frame 113 may be connected to an undercarriage 121 and may be configured to swing about a vertical axis 122 by a hydraulic swing motor 123. Any of the boom hydraulic cylinders 115, the stick hydraulic cylinder 118, the tool hydraulic cylinder 119, and the swing motor 123 may be operatively coupled to the hydraulic pump assembly 127 for transmission of mechanical power therebetween.

Numerous different work tools 104 may be attached to a single machine 100 and controlled by an operator. The work tool 104 may include any device used to perform a particular task such as, for example, a bucket, a fork arrangement, a blade, a shovel, a ripper, a dump bed, a broom, a snow blower, a propelling device, a cutting tool, a grasping device, or any other task-performing device known in the art. The exemplary work tool 104 illustrated in FIG. 1 is a cutting tool, including a rotating saw 124 that is driven by a saw motor 125. According to an aspect of the disclosure, the saw motor 125 is a hydraulic motor that is operatively coupled to the hydraulic pump assembly 127 for transmission of mechanical power therebetween.

The travel system 106 may include one or more traction devices powered to propel the machine 100. As illustrated in FIG. 1, the travel system 106 may include a pair of tracks 129, including a left track located on one side of the machine 100, and a right track located on another side of the machine 100 opposite the left track. The pair of tracks 129 may be driven by a pair of travel motors 130, including a right travel motor and a left travel motor independently coupled to the right track and the left track, respectively. It will be appreciated that the travel system 106 could alternatively or additionally include traction devices other than tracks, such as wheels, belts, or other traction devices known in the art.

The operator station 110 may include devices that receive input from an operator indicative of desired maneuvering. Specifically, the operator station 110 may include one or more control interface devices 111, for example a joystick, a steering wheel, a pedal, a button, a touch screen, combinations thereof, or any other user input device known in the art. The control interface devices 111 may initiate movement of the machine 100, including for example travel and/or tool movement relative to the work surface 114, by producing displacement signals that are indicative of desired machine 100 maneuvering. As an operator actuates a control interface device 111, the operator may effect a corresponding machine 100 movement in a desired direction, with a desired speed, with a desired force, or combinations thereof.

Alternatively or additionally, the control interface device 111 may include provisions for receiving control inputs transmitted remotely from the operator station 110, including wired or wireless telemetry, for example. The power system 108, the travel system 106, the implement system 102, or combinations thereof, may be operatively coupled to one another via a controller 128.

Figure 2:
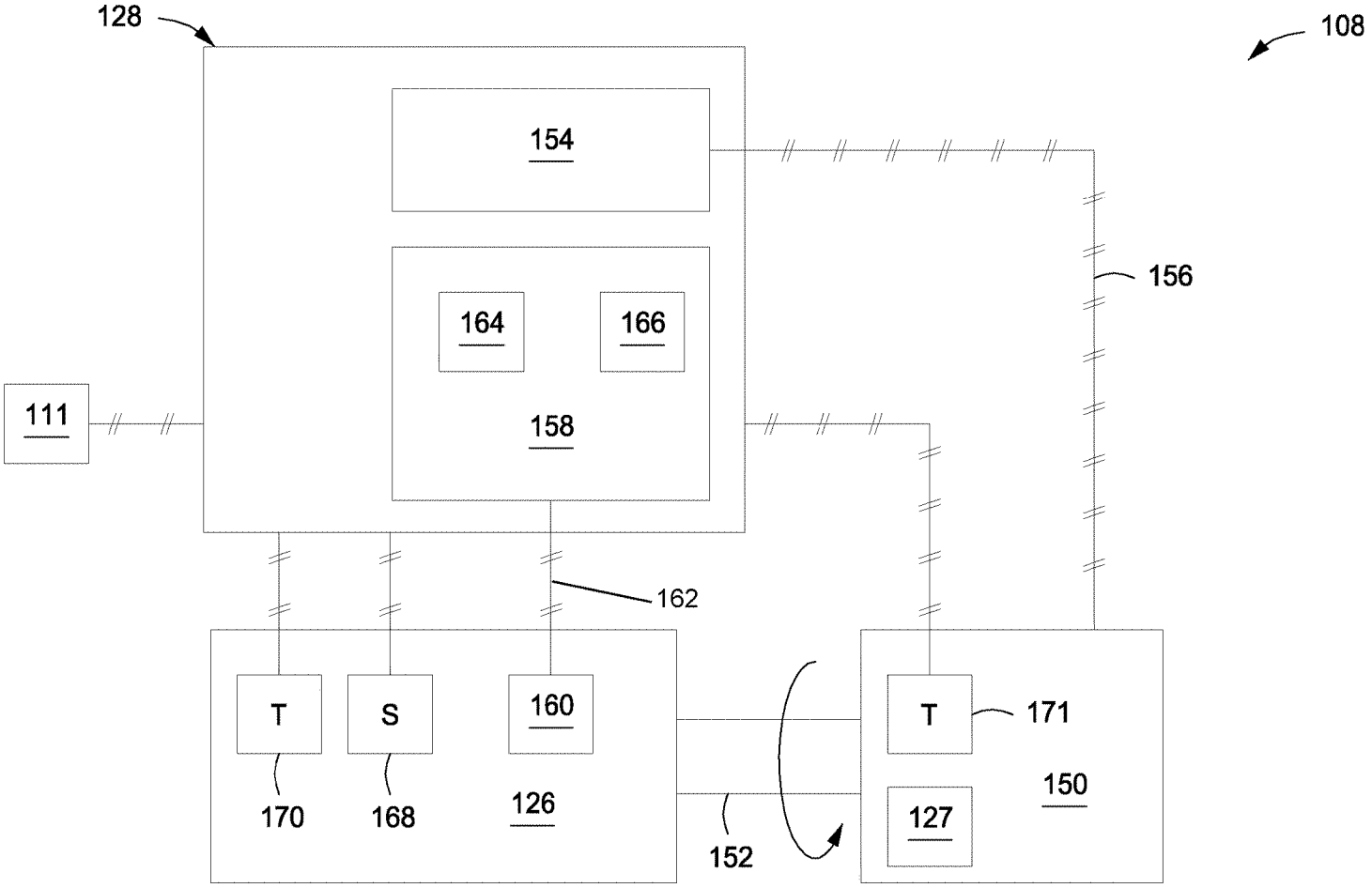
FIG. 2 is a schematic diagram of a power system, according to an aspect of the disclosure.

FIG. 2 is a schematic diagram of a power system 108, according to an aspect of the disclosure. The engine 126 may be operatively coupled to a hydraulic system 150 via one or more shafts 152 for transmission of mechanical power therebetween. Alternatively or additionally, the hydraulic system 150 may be operatively coupled to the engine 126 via other structures, such as a belt and pulley arrangement, a gear box, or any other mechanical power transmission structure known in the art.

The controller 128 may include a hydraulic control module 154 that is operatively coupled to the hydraulic system 150 via one or more conductors 156. The one or more conductors 156 may transmit control signals from the hydraulic control module 154 to actuators in the hydraulic system 150, transmit sensor signals from sensors in the hydraulic system 150 to the hydraulic control module 154, combinations thereof, or transmit any other signal known in the art to benefit the control of a hydraulic system. Further, the controller 128 may be operatively coupled to the one or more control interface devices 111, at least in part for receiving control parameters input by an operator of the machine 100, transmitting control parameters for display to the operator, or combinations thereof.

The controller 128 may include a speed governor module 158 that is operatively coupled to a fuel system 160 of the engine 126 via one or more conductors 162. The one or more conductors 162 may transmit control signals from the speed governor module 158 to actuators, such as fuel injectors (not shown), in the fuel system 160, transmit sensor signals from the fuel system 160 to the speed governor module 158, combinations thereof, or transmit any other signal known in the art to benefit the control of an internal combustion engine. The speed governor module 158 may include a throttle drop module 164, an automatic idle adjustment module 166, or both, as further described below.

The engine 126 may include a speed sensor 168, a temperature sensor 170, or both, being operatively coupled to the controller 128. The speed sensor 168 may transmit a signal to the controller 128 that is indicative of a rotational speed of the engine 126, such as, a speed of a crankshaft of the engine 126, a speed of a camshaft of the engine 126, combinations thereof, or a signal indicative of any other engine speed characterizing measurement. The temperature sensor 170 may transmit a signal to the controller 128 that is indicative of a temperature of an engine fluid, such as coolant or lubricating oil, or a temperature of a structure of the engine 126, such as a block metal temperature or a head metal temperature, for example.

It will be appreciated that any conductors operatively coupling the controller 128 to other structures in the machine 100 may include electrical conductors, pneumatic conduits, hydraulic conduits, mechanical linkages, wireless transmitters and receivers, or any other means for conducting a signal known in the art.

The controller 128 may be any purpose-built processor for effecting control of any aspect of the machine 100. The controller 128 may be embodied in a single housing, or a plurality of housings distributed throughout the machine 100. Further, the controller 128 may include power electronics, preprogrammed logic circuits, data processing circuits, volatile memory, non-volatile memory, software, firmware, input/output processing circuits, combinations thereof, or any other controller structures known in the art.

Any of the methods or functions described herein may be effected by, performed by, or controlled by the controller 128. Further, any of the methods or functions described herein may be embodied in a non-transitory machine-readable medium for causing the controller 128 to perform the methods or functions described herein. Such non-transitory machine-readable media may include magnetic disks, optical discs, solid state disk drives, combinations thereof, or any other non-transitory machine-readable medium known in the art. According to an aspect of the disclosure, the machine-readable media is computer-readable media. Moreover, it will be appreciated that the methods and functions described herein may be incorporated into larger control schemes for an engine, a machine, or combinations thereof, including other methods and functions not described herein.

Figure 3:
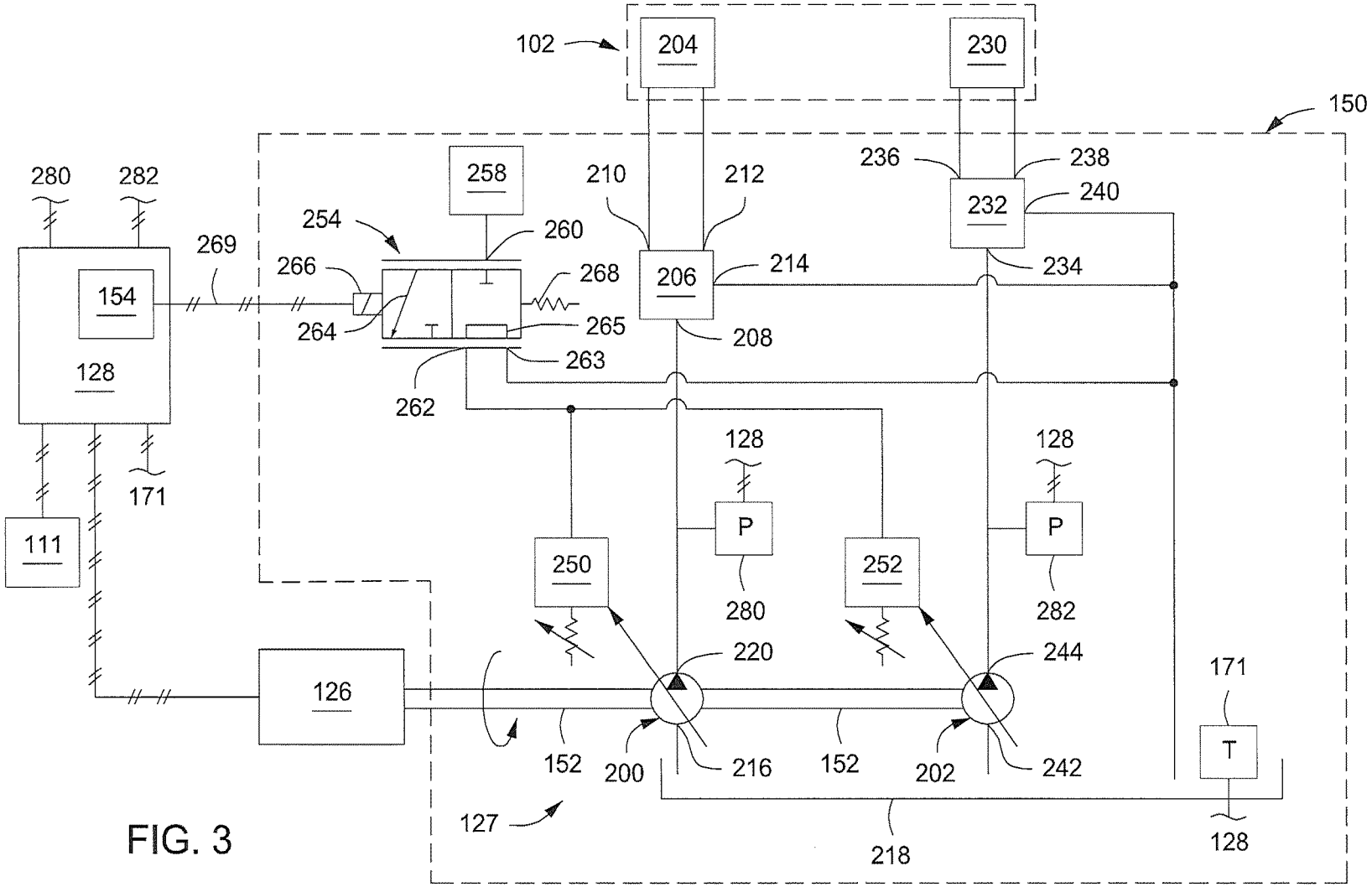
FIG. 3 is a schematic diagram of a hydraulic system, according to an aspect of the disclosure.

FIG. 3 is a schematic diagram of a hydraulic system 150, according to an aspect of the disclosure. As illustrated in FIG. 3, the hydraulic pump assembly 127 includes a first hydraulic pump 200 and a second hydraulic pump 202, each being operatively coupled to the engine 126 for transmission of mechanical power therebetween. Although the first hydraulic pump 200 and the second hydraulic pump 202 are shown coupled to the engine 126 via a common shaft 152, it will be appreciated that the first hydraulic pump 200 and the second hydraulic pump 202 may be coupled to the engine 126 via separate and distinct shafts or other drive means known in the art.

The first hydraulic pump 200 is in selective fluid communication with a first load 204 via a first valve assembly 206. The first valve assembly 206 may define a first port 208, a second port 210, a third port 212, and a fourth port 214, and may be configured to effect different states of fluid communication between those ports. An inlet 216 of the first hydraulic pump 200 may be fluidly coupled to a hydraulic fluid reservoir 218, and a discharge 220 of the first hydraulic pump 200 maybe fluidly coupled to the first port 208 of the first valve assembly 206. The second port 210 and the third port 212 of the first valve assembly 206 may be fluidly coupled to separate ports of the first load 204, and the fourth port 214 of the first valve assembly 206 may be fluidly coupled to the reservoir 218.

In a first configuration, the first valve assembly 206 may block fluid communication between the first port 208 and both of the second port 210 and the third port 212, and may block fluid communication between the fourth port 214 and both of the second port 210 and the third port 212, thereby blocking fluid communication between the first load 204 and both the first hydraulic pump 200 and the reservoir 218. In a second configuration, the first valve assembly 206 may effect fluid communication between the first port 208 and the second port 210, and effect fluid communication between the third port 212 and the fourth port 214, thereby performing work on the first load 204 in a first direction. In a third configuration, the first valve assembly 206 may effect fluid communication between the first port 208 and the third port 212, and effect fluid communication between the second port 210 and the fourth port 214, thereby performing work on the first load 204 in a second direction.

The second hydraulic pump 202 is in selective fluid communication with a second load 230 via a second valve assembly 232. The second valve assembly 232 may define a first port 234, a second port 236, a third port 238, and a fourth port 240, and may be configured to effect different states of fluid communication between those ports. An inlet 242 of the second hydraulic pump 202 may be fluidly coupled to the hydraulic fluid reservoir 218, and a discharge 244 of the second hydraulic pump 202 maybe fluidly coupled to the first port 234 of the second valve assembly 232. The second port 236 and the third port 238 of the second valve assembly 232 may be fluidly coupled to separate ports of the second load 230, and the fourth port 240 of the second valve assembly 232 may be fluidly coupled to the reservoir 218.

In a first configuration, the second valve assembly 232 may block fluid communication between the first port 234 and both of the second port 236 and the third port 238, and may block fluid communication between the fourth port 240 and both of the second port 236 and the third port 238, thereby blocking fluid communication between the second load 230 and both the second hydraulic pump 202 and the reservoir 218. In a second configuration, the second valve assembly 232 may effect fluid communication between the first port 234 and the second port 236, and effect fluid communication between the third port 238 and the fourth port 240, thereby performing work on the second load 230 in a first direction. In a third configuration, the second valve assembly 232 may effect fluid communication between the first port 234 and the third port 238, and effect fluid communication between the second port 236 and the fourth port 240, thereby performing work on the second load 230 in a second direction.

The first hydraulic pump 200 may be a variable displacement pump, such that control action of a first pump actuator 250 may vary a volumetric flow rate of the first hydraulic pump 200 at a constant speed of the first hydraulic pump 200. Similarly, the second hydraulic pump 202 may be a variable displacement pump, such that control action of a second pump actuator 252 may vary a volumetric flow rate of the second hydraulic pump 202 at a constant speed of the second hydraulic pump 202. According to an aspect of the disclosure, the first pump actuator 250, the second pump actuator 252, or both, may be swashplate actuators configured to adjust the displacement of their respective pumps, or any other actuator known in the art for varying a displacement of a pump.

Alternatively or additionally, the first pump actuator 250 or the second pump actuator 252 may vary a pressure rise across its respective pump, for example, by varying a restriction in a recirculation conduit extending from the discharge to the inlet of the respective pump. Alternatively or additionally still, the first hydraulic pump 200, the second hydraulic pump 202, or both may be variable speed pumps, and the first pump actuator 250 and the second pump actuator 252 may act to vary a speed of their respective pumps. Thus, a load of the first hydraulic pump 200, the second hydraulic pump 202, or both, may be actuated by varying a displacement of the respective pump, varying a pressure rise across the respective pump, varying a speed of the respective pump, or combinations thereof.

According to an aspect of the disclosure, an increasing magnitude of a control signal applied to either the first pump actuator 250 or the second pump actuator 252 acts to decrease a load of the corresponding hydraulic pump 200, 202 on the engine 126. Thus, a load of at least one hydraulic pump may be configured to vary inversely with a magnitude of a pump control signal. According to another aspect of the disclosure, an increasing magnitude of a control signal applied to either the first pump actuator 250 or the second pump actuator 252 acts to decrease a displacement of the corresponding hydraulic pump 200, 202 on the engine 126.

Referring still to FIG. 3, the first pump actuator 250 and the second pump actuator 252 are each operatively coupled to the hydraulic control module 154 of the controller 128. According to an aspect of the disclosure, the first pump actuator 250 and the second pump actuator 252 are operatively coupled to the hydraulic control module 154 via a pilot valve 254. According to another aspect of the disclosure, the first pump actuator 250 is operatively coupled to the hydraulic control module 154 via a first pilot valve, and the second pump actuator 252 is operatively coupled to the hydraulic control module 154 via a second pilot valve that is distinct from the first pilot valve, such that the hydraulic control module 154 may effect independent control of the first pump actuator 250 and the second pump actuator 252.

The pilot valve 254 may be a three-port, two-position valve, as shown on FIG. 3. A first port 260 of the pilot valve 254 is fluidly coupled to a pilot fluid source 258, a second port 262 of the pilot valve 254 is fluidly coupled to the first pump actuator 250 and the second pump actuator 252, and a third port 263 of the pilot valve 254 is fluidly coupled to the reservoir 218. In a first configuration, the pilot valve 254 blocks fluid communication between the first port 260 and both the second port 262 and the third port 263, and effects fluid communication between the second port 262 and the third port 263 via a flow passage 265. In a second configuration, the pilot valve 254 effects fluid communication between the first port 260 and the second port 262 via a flow passage 264, and blocks fluid communication between the third port 263 and both the first port 260 and the second port 262.

The pilot valve 254 may include an actuator 266 and a resilient member 268, such that energizing the actuator 266 acts to bias the pilot valve 254 against the resilient member 268 to actuate the pilot valve 254 from its first configuration toward its second configuration. The actuator 266 may be operatively coupled to the hydraulic control module 154 by a signal conductor 269, such that the hydraulic control module 154 may control actuation of the pilot valve 254. The actuator 266 may be a solenoid actuator, a hydraulic actuator, a pneumatic actuator, combinations thereof, or any other valve actuator known in the art.

According to an aspect of the disclosure, the pilot valve 254 is a proportional valve, such that a flow resistance between the first port 260 and the second port 262 along the flow passage 264 may assume a plurality of values between the first configuration and a wide open configuration in response to a plurality of control signal magnitudes transmitted from the hydraulic control module 154 to the actuator 266; and a flow resistance between the second port 262 and the third port 263 along the flow passage 265 may assume a plurality of values between the second configuration and a wide open configuration in response to the plurality of control signal magnitudes transmitted from the hydraulic control module 154 to the actuator 266. According to another aspect of the disclosure, the actuator 266 is a solenoid actuator that is configured to effect a plurality of flow resistances between the first port 260 and the second port 262, and between the second port 262 and the third port 263, in response to a plurality of electrical current magnitudes applied to the actuator 266 by the hydraulic control module 154.

The hydraulic system 150 may include a first pressure sensor 280 in fluid communication with the discharge 220 of the first hydraulic pump 200, a second pressure sensor 282 in fluid communication with the discharge 244 of the second hydraulic pump 202, or both. The first pressure sensor 280, the second pressure sensor 282, or both, may be operatively coupled to the controller 128 for transmission of signals indicative of respective hydraulic pressures to the controller 128.

The hydraulic system 150 may include a temperature sensor 171 that is operatively coupled to the controller 128 for transmission of signals indicative of temperatures within the hydraulic system 150. The temperature sensor 171 may be used to sense a structural temperature of equipment in the hydraulic system 150 or a fluid temperature within the hydraulic system 150. According to an aspect of the disclosure, the temperature sensor 171 senses a temperature of hydraulic fluid residing within the reservoir 218.

Referring still to FIG. 3, the first load 204 may be an actuator in the travel system 106, and the second load 230 may be an actuator in the implement system 102. According to an aspect of the disclosure, the first load 204 includes one or more of the hydraulic travel motors 130. According to another aspect of the disclosure, the second load 230 includes at least one of the boom hydraulic cylinders 115, the stick hydraulic cylinder 118, the tool hydraulic cylinder 119, the saw motor 125, or a combination thereof.

Figure 4:
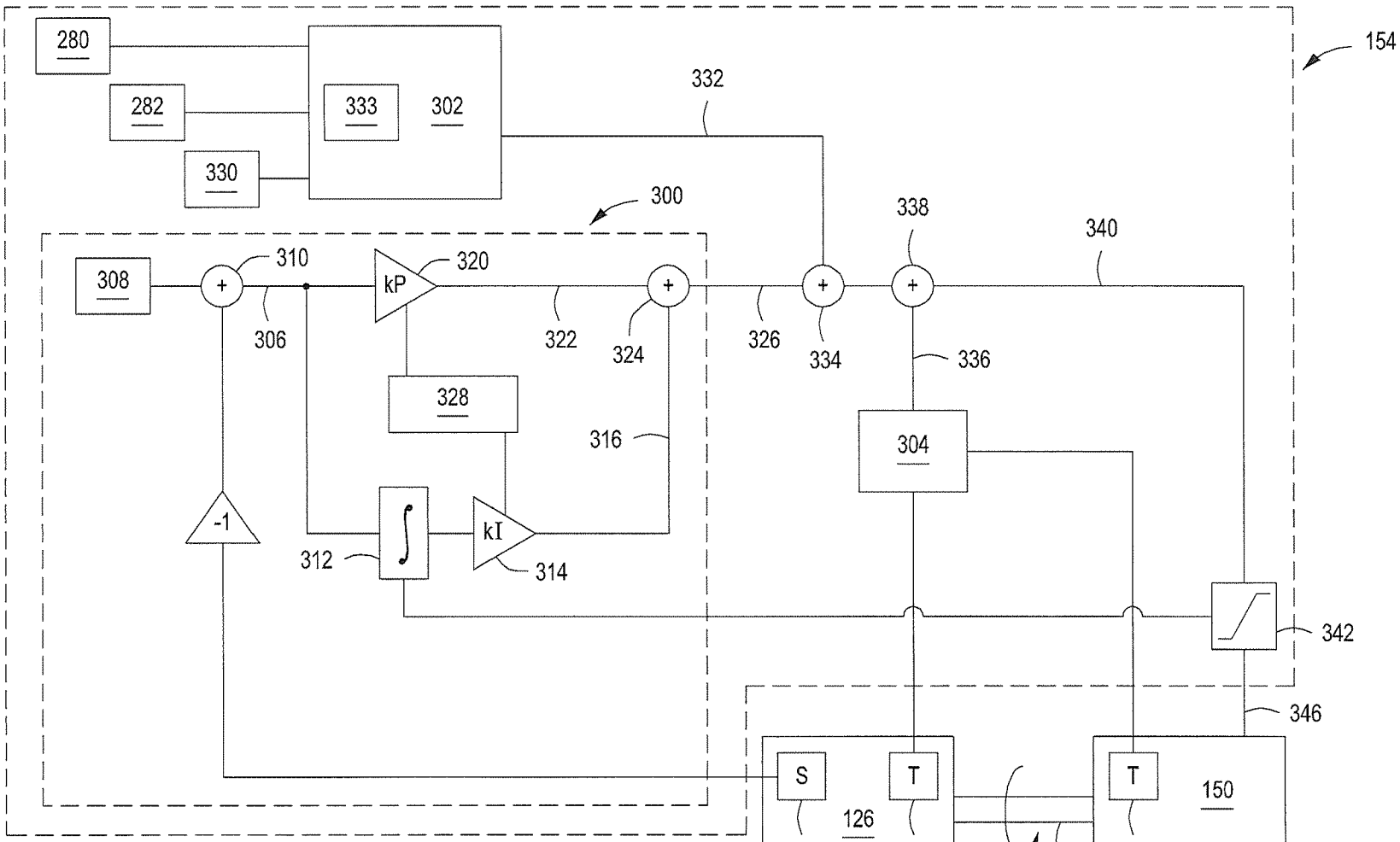
FIG. 4 is a schematic diagram of a pump control module, according to an aspect of the disclosure.

FIG. 4 is a schematic diagram of a hydraulic control module 154, according to an aspect of the disclosure. The hydraulic control module 154 may include a closed-loop gain module 300, a preload gain module 302, a temperature gain module 304, or combinations thereof. The closed-loop gain module 300 receives an engine speed signal from the speed sensor 168 and determines a lug speed error 306 as the difference between a target lug speed 308 and the measured engine speed via the comparator 310. The lug speed error 306 may be integrated with respect to time in the integrator 312 and scaled by an integral gain (kI) in the multiplication block 314 to yield an integral control signal 316. Alternatively or additionally, the lug speed error 306 may be scaled by a proportional gain (kP) in the multiplication block 320 to yield a proportional control signal 322. The integral control signal 316 is superimposed with the proportional control signal 322 via the comparator 324 to yield a closed-loop control signal 326. A gain determination module 328 may determine a value of the integral gain (kI) and transmit the value of the integral gain (kI) to the multiplication block 314, determine a value of the proportional gain (kP) and transmit the value of the proportional gain (kP) to the multiplication block 320, or combinations thereof, as will be described later.

Although not shown in FIG. 4, it will be appreciated that the closed-loop gain module 300 may also include provisions for a derivative control signal, according to conventional methods and control structures, which could be further superimposed with the proportional control signal 322, the integral control signal 316, or both, to yield the closed-loop control signal 326.

The preload gain module 302 may receive signals from the first pressure sensor 280, the second pressure sensor 282, or both, in addition to a target engine speed value 330. In turn, the preload gain module 302 may determine a preload control signal 332 as a function of the signal from the first pressure sensor 280, the signal from the second pressure sensor 282, the target engine speed value 330, combinations thereof, or any other pump or engine control input known in the art. The preload gain module 302 may include a low-pass filter 333 for conditioning the signal from the first pressure sensor 280, the signal from the second pressure sensor 282, or a combination of the signal from the first pressure sensor 280 and the signal from the second pressure sensor 282. The preload control signal 332 may be superimposed with the closed-loop control signal 326 via the comparator 334. According to an aspect of the disclosure, the preload gain module 302 is an open-loop control module.

The temperature gain module 304 may receive a signal from the engine temperature sensor 170, the hydraulic temperature sensor 171, or both, and determine a temperature control signal 336 based on the signal from the engine temperature sensor 170, the signal from the hydraulic temperature sensor 171, combinations thereof, or any other pump or engine control input known in the art. The temperature control signal 336 may be superimposed with the closed-loop control signal 326, the preload control signal 332, or both, via the comparator 338 to yield a pump control signal 340.

The pump control signal 340 may be conditioned in a saturation module 342 to limit the magnitude of the pump control signal 340 to less than or equal to a high-limit value, greater than or equal to a low-limit value, or both. The integrator 312 may be operatively coupled to a saturation module 342 for ceasing integration of the lug speed error 306 when the saturation module 342 is saturated at one of the low-limit value or the high-limit value, and resuming integration of the lug speed error 306 when the saturation module 342 is in a non-saturated state, i.e., below the high-limit value and above the low-limit value. According to an aspect of the disclosure, the high-limit value of the saturation module 342 corresponds to a pump control signal 340 that would actuate the pilot valve 254 to a wide-open or substantially wide-open position. According to another aspect of the disclosure, the high-limit value of the saturation module 342 effects a maximum decrease in the load of the hydraulic pump assembly 127.

Further, the pump control signal 340 may be conditioned in an amplifier to convert the nature of the pump control signal 340 from one signal form to another, for example, from a voltage signal to a current signal; to further scale the dynamic range of the pump control signal 340; or combinations thereof. The pump control signal 340 is transmitted to the hydraulic system 150 via the signal conductor 346.

According to an aspect of the disclosure, signal conductor 346 includes the signal conductor 269 to the pilot valve 254 (FIG. 3). Thus, the hydraulic control module 154 may transmit the pump control signal 340 to the hydraulic system 150 to control a load of the first hydraulic pump 200, the second hydraulic pump 202, or both.

INDUSTRIAL APPLICABILITY

The present disclosure is applicable to apparatus and methods for controlling a hydraulic pump system and, more particularly, to apparatus and methods for controlling a power system including an engine operatively coupled to a hydraulic pump system. Referring to FIG. 1, the hydraulic pump assembly 127 receives mechanical power from the engine 126, and under some circumstances the sum of loads applied to the engine 126 by the hydraulic pump assembly 127 may exceed a rated power of the engine 126, thereby stalling the engine 126. For example, simultaneous use of several actuators in the implement system 102 and one or more actuators in the travel system 106, when the machine 100 is located on steep terrain, may act to stall the engine 126 independent of the design of the engine speed governor module 158.

Sizing the engine 126 to have less rated power than the highest possible sum of loads on the engine 126 may offer advantages of reduced size of the machine 100, reduced capital cost of the machine 100, reduced maintenance costs for the machine 100, improved fuel economy for the machine 100, or combinations thereof. However, as described above, these benefits are balanced against the probability of occasionally stalling the engine 126 during extremely high load states. Thus, a control action to reduce a load of one or more hydraulic pumps in the hydraulic pump assembly 127, according to aspects of the disclosure, combined with control action of the speed governor module 158, may enable operation of the machine 100 without risk of engine stall, while still enjoying the benefits of a machine 100 having an engine 126 rating that is less than the maximum possible sum of loads on the engine 126. Further, a control action to reduce a load of one or more hydraulic pumps in the hydraulic pump assembly 127, according to aspects of the disclosure, may enable an operator to operate the machine closer to the full power rating of the engine 126 without concern for stalling the engine 126.

Figure 5:
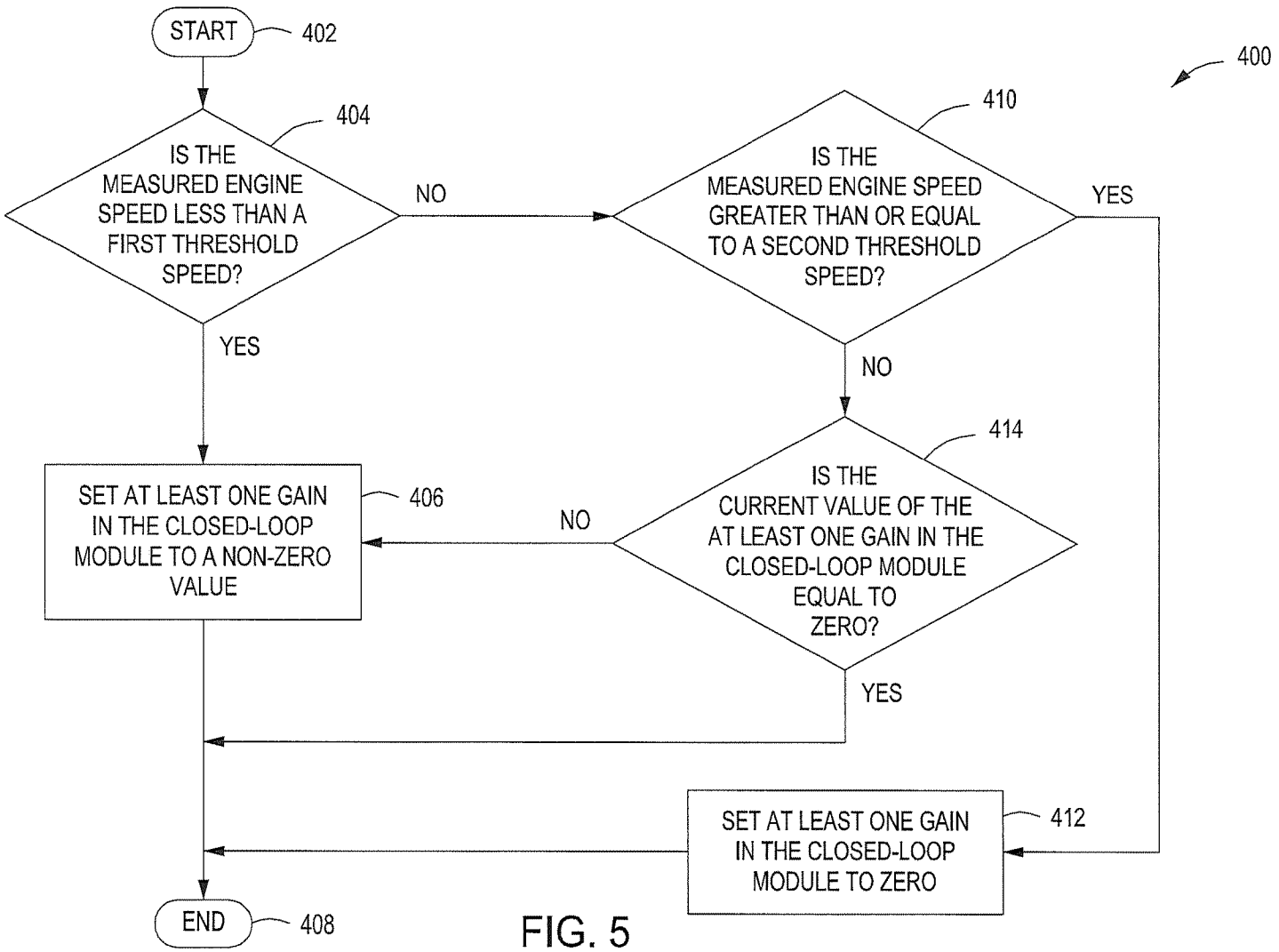
FIG. 5 is a flowchart for a process of a gain determination module, according to an aspect of the disclosure.

FIG. 5 is a flowchart of a process 400 for a gain determination module 328, according to an aspect of the disclosure. The process 400 starts at step 402. In step 404 the gain determination module 328 determines whether a measured engine speed is less than a first threshold speed. The measured engine speed may be based on a signal from the engine speed sensor 168, as shown in FIG. 4. According to an aspect of the disclosure, the first threshold speed is the target lug speed 308 (see FIG. 4). The target lug speed 308 may be a predetermined constant value stored in a memory of the controller 128, or may be based on a difference between a target engine speed 330 and a lug speed drop value stored in the memory of the controller 128. As a non-limiting example, a target lug speed 308 may be calculated as a target engine speed of 2100 rpm minus a lug speed drop value of 150 rpm, yielding a target lug speed 308 value of 1950 rpm.

If the measured engine speed is less than the first threshold speed, then the process 400 proceeds to step 406 where at least one gain in the closed-loop module is set to a non-zero value. The at least one gain in the closed-loop module may include the integral gain 314, the proportional gain 320, a differential gain, or combinations thereof. According to an aspect of the disclosure, the integral gain 314 and the proportional gain 320 are each set to an identical or distinct non-zero value in step 406. According to another aspect of the disclosure all gains in the closed-loop gain module 300 are set to a non-zero value in step 406. Therefore, when the lug speed error 306 is non-zero, and at least one gain in the closed-loop gain module 300 is non-zero, then the closed-loop gain module 300 may contribute to the pump control signal 340, and the closed-loop gain module 300 may be said to be active.

The non-zero values for gains in the closed-loop gain module 300 may be constant values, or alternatively, may be functionally related to measurements or other control parameters stored in the memory of the controller 128. According to an aspect of the disclosure, the integral gain 314 and the proportional gain 320 each increase with increases in the lug speed error 306. According to another aspect of the disclosure, the integral gain 314 and the proportional gain 320 each increases monotonically with increasing lug speed error 306 for lug speed errors 306 greater than zero, such that the measured engine speed is less than the target lug speed 308. According to another aspect of the disclosure, the integral gain 314 and the proportional gain 320 each increases linearly with increasing lug speed error for lug speed errors 306 greater than zero. According to another aspect of the disclosure, the integral gain 314 and the proportional gain 320 are each constant over a range of lug speed errors 306 less than zero, when the measured engine speed is greater than the target lug speed 308. Alternatively or additionally, it will be appreciated that the any of the gains in the closed-loop gain module 300 may vary with one or more control parameters according to a stair-step schedule, a polynomial schedule, a spline-based schedule, combinations thereof, or any other schedule known in the art for varying a control gain value.

It will be appreciated that relations between gains in the closed-loop gain module 300 and other measurements or control parameters may be embodied in mathematical equations, lookup tables, physics-based models, combinations thereof, or any other model structure known in the art. Following step 406, the process 400 ends at step 408

If the measured engine speed is not less than the first threshold speed in step 404, the process 400 proceeds to step 410 where the gain determination module 328 determines whether the measured engine speed is greater than or equal to a second threshold speed. According to an aspect of the disclosure, the second threshold speed equals the first threshold speed. According to another aspect of the disclosure the second threshold speed is greater than the first threshold speed and less than a target engine speed.

The second threshold speed may be a constant value stored in the memory of the controller 128, or alternatively the second threshold speed may be calculated based on measurements or control parameters stored with in the controller 128. According to an aspect of the disclosure, the second threshold speed is calculated as the target lug speed 308 plus a first speed offset value. For example, the target lug speed may be 1950 rpm and the first speed offset value may be 100 rpm, yielding a second threshold speed of 2050 rpm. According to another aspect of the disclosure, the second threshold speed is calculated as the lesser of the target lug speed 308 plus the first speed offset value, and a target engine speed minus a second speed offset value. Thus, the determination of the second threshold speed value may account for variations in the target engine speed, variations in the target lug speed, or both.

If the measured engine speed is greater than or equal to the second threshold speed in step 410, then the process 400 proceeds to step 412 where at least one gain in the closed-loop gain module 300 is set to zero. According to an aspect of the disclosure, both the integral gain 314 and the proportional gain 320 are set to zero in step 412. According to another aspect of the disclosure, all gains of the closed-loop gain module 300 are set to zero in step 412, thereby disabling the closed-loop gain module 300 from contributing to the pump control signal 340. From step 412, the process 400 ends at step 408.

If the measured engine speed is not greater than or equal to the second threshold speed in step 410, then the process 400 proceeds to step 414 where the gain determination module 328 determines whether the current value of the at least one gain in the closed-loop module is equal to zero. If the current value of the at least one gain in the closed-loop module is equal to zero, then the process 400 ends at step 408. According to an aspect of the disclosure, when all gains of the closed-loop gain module 300 are equal to zero in step 414, then the process 400 ends at step 408.

If the current value of the at least one gain in the closed-loop module is not equal to zero, then the process 400 proceeds to step 406 where the at least one gain in the closed-loop module is set to the same non-zero value or an updated non-zero value, and the process 400 ends at step 408.

It will be appreciated that when the second threshold value is greater than the first threshold value, the process 400 results in a hysteresis loop with respect to activation or deactivation of the closed-loop gain module 300 as a function of measured engine speed relative to the target lug speed 308. For example, beginning in a state where all gains in the closed-loop gain module 300 are set to a value of zero, the measured engine speed has to drop below the first threshold speed, which may be the target lug speed 308, to activate the closed-loop gain module 300 in step 406. However, once activated, the closed-loop gain module 300 may not deactivate in step 412 until the measured engine speed rises above both the first threshold speed and the second threshold speed.

Activation of the closed-loop gain module 300 by setting at least one closed-loop gain to a non-zero value may act to prevent stalling of the engine 126 when highly loaded by the hydraulic pump assembly 127, and stall is avoided by decreasing a load applied to the engine 126 by the hydraulic pump assembly 127 when the engine speed decreases to near or below a target lug speed 308. Further, setting the at least one closed-loop gain to zero when the engine speed is sufficiently in excess of the target lug speed 308 may act to maximize hydraulic power capacity of the hydraulic system 150 ready for transmission to the implement system 102 (see FIG. 1).

Referring to FIG. 3, the pilot valve 254 may be configured to receive a control signal ranging from a low value to a high value. For example, the pilot valve 254 may be configured to receive an electrical current signal ranging from zero to 1500 mA. Further, the pilot valve 254 may exhibit a dead band at the lower end of the full control signal range. For example, the same pilot valve configured to receive an electrical current signal ranging from zero to 1500 mA may remain in a closed condition in response to the control signal range of zero to 1000 mA, and then open in response to control signals greater than 1000 mA. Applicants identified advantages for promoting the responsiveness of the pilot valve 254 by maintaining a preload control current on the pilot valve 254 near the top of the dead band range.

Figure 6:
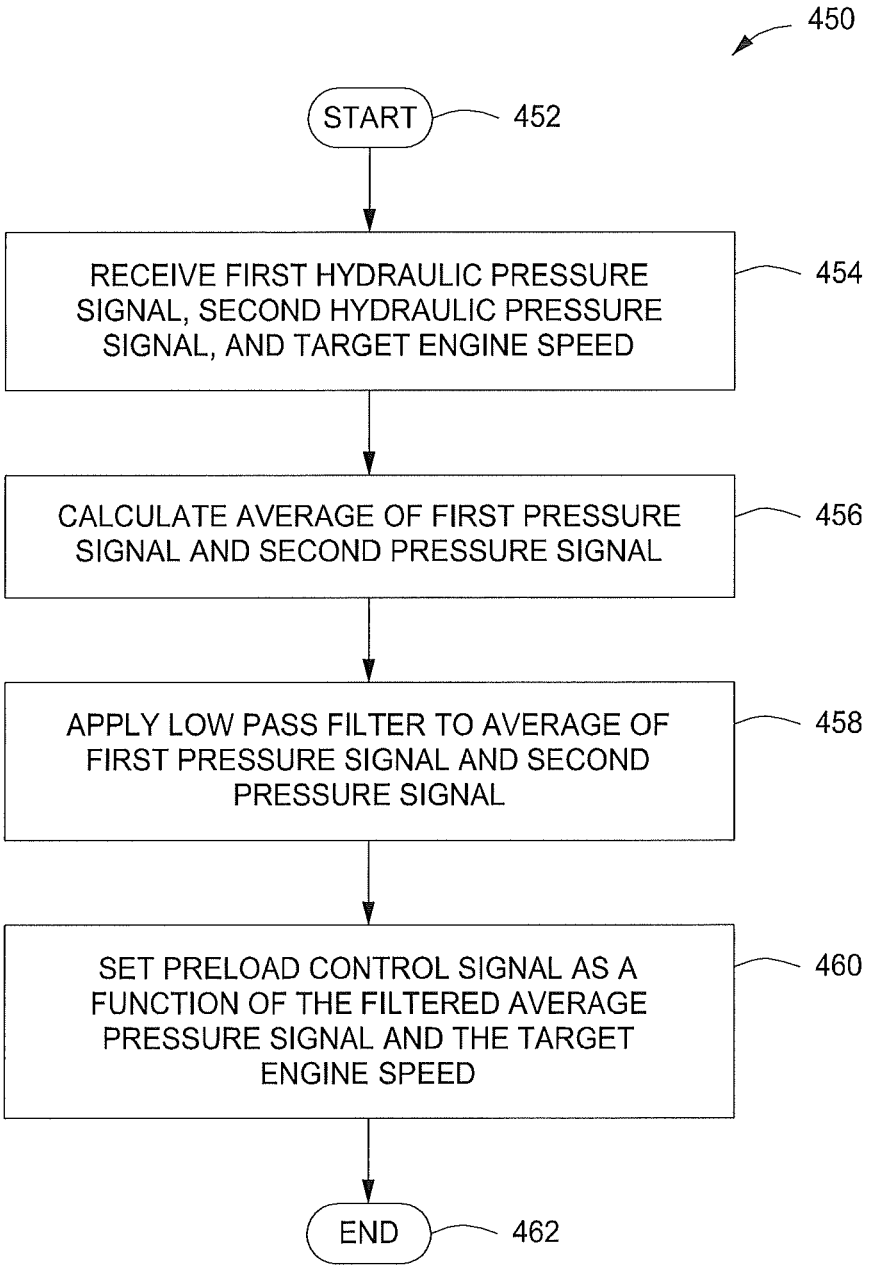
FIG. 6 is a flowchart for a process of a preload gain module, according to an aspect of the disclosure.

FIG. 6 is a flowchart of a process 450 for a preload gain module 302, according to an aspect of the disclosure. The process 450 begins at step 452. In a non-limiting aspect of the disclosure, the preload gain module 302 receives a first hydraulic pressure signal, a second hydraulic pressure signal, and a signal indicative of a target engine speed 330. The first hydraulic pressure signal may be based on a measurement by the first pressure sensor 280, and the second hydraulic pressure signal may be based on a measurement by the second pressure sensor 282.

However, it will be appreciated that the preload gain module 302 may receive fewer signals at step 454, or additional signals, based on the needs of particular application. For example, if the machine 100 included only one hydraulic pump 200, then the preload gain module 302 may only receive one pressure signal indicative of a pressure downstream of a discharge of the one hydraulic pump 200. Likewise, if the machine 100 included more than two hydraulic pumps, then the preload gain module 302 may receive more than two pressure signals, each signal corresponding to one of the more than two pumps. According to an aspect of the disclosure, the preload gain module 302 receives a pressure signal corresponding to each hydraulic pump in the hydraulic pump assembly 127. According to another aspect of the disclosure, the preload gain module 302 receives a number of pressure signals that is less than the total number of hydraulic pumps in the hydraulic pump assembly 127.

In step 456, the preload gain module 302 optionally calculates an average of the first pressure signal and the second pressure signal. However, it will be appreciated that the preload gain module 302 may not calculate an average pressure value, particularly when it receives only one pressure signal. Alternatively, it will be appreciated that the preload gain module 302 may calculate an average over more than two pressure signals when the preload gain module 302 receives more than two pressure signals.

In step 458, the preload gain module 302 may optionally apply a low-pass filter 333 to the average pressure signal. Alternatively, the preload gain module 302 may apply the low-pass filter 333 to only one pressure signal of a plurality of pressure signals, especially when the preload gain module 302 receives only one pressure signal. Applying the low-pass filter 333 to the average pressure signal, or a single pressure signal, may provide the advantages of smoothing the signal so conditioned, accelerating load shedding of the hydraulic pump assembly 127 in response to the pump control signal 340, or combinations thereof.

In step 460, the preload gain module 302 sets the preload control signal 332 as a function of the average pressure signal and the target engine speed, according to a non-limiting aspect of the disclosure. The preload gain module 302 may set the preload control signal 332 based on one or more mathematical relations, a lookup table, a physics-based model, or any other model known in the art. As a non-limiting example, the preload gain module 302 may set the preload control signal 332 based on a lookup table graphically represented in FIG. 9.

Figure 9:
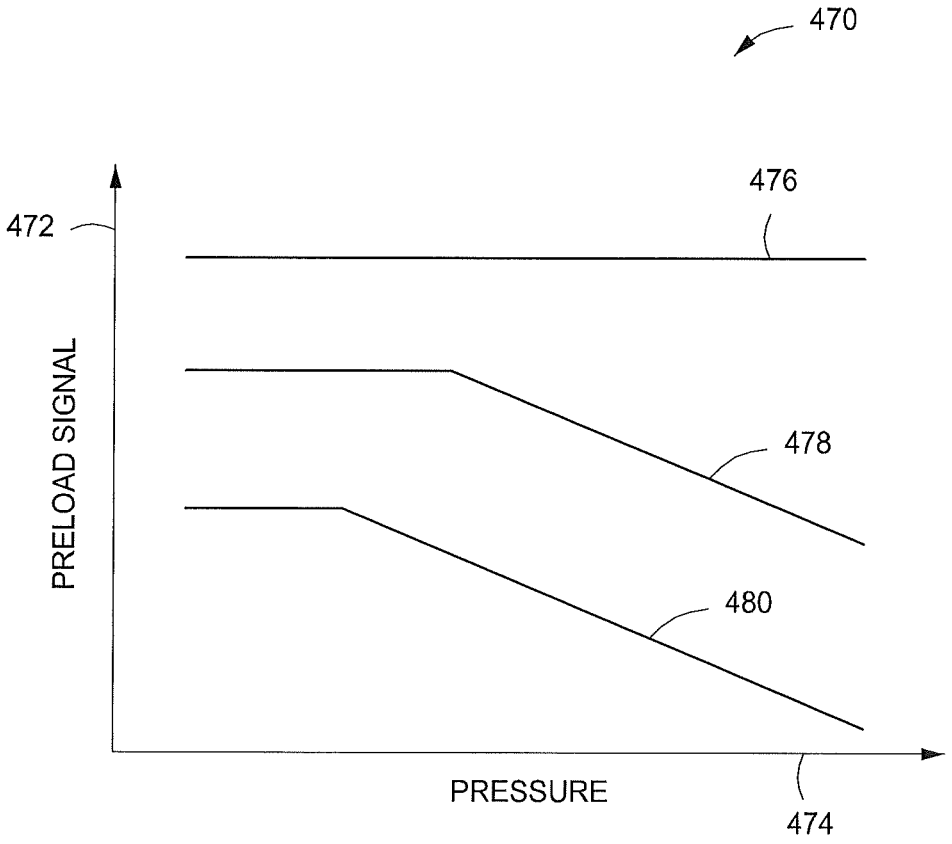
FIG. 9 is a graphical representation of a lookup table for preload control signal values, according to an aspect of the disclosure.

FIG. 9 is a graphical representation of a lookup table 470 for preload control signal values 332, according to an aspect of the disclosure. In FIG. 9, the vertical axis 472 may be a magnitude of the preload control signal 332, and the horizontal axis 474 may be a hydraulic pressure. The hydraulic pressure may correspond to an average over a plurality of pressure signals or may correspond to a single pressure signal, as described above.

Curve 476 may be indicative of the preload control signal 332 at a first target engine speed value. Curve 478 may be indicative of the preload control signal 332 at a second target engine speed value that is greater than the first target engine speed value. And finally, curve 480 may be indicative of the preload control signal 332 at a third target engine speed value that is greater than the second target engine speed value. It will be appreciated that the lookup table 470 may include more or fewer lines of constant target engine speed, or may be parameterized differently from that shown in FIG. 9, without departing from the scope of the present disclosure.

As shown in FIG. 9, the preload control signal 332 may assume a high value at low target engine speeds 330, independent of a hydraulic pressure input, as exemplified in curve 476. Alternatively or additionally, the preload control signal 332 may decrease with increasing hydraulic pressure at higher target engine speeds 330. Alternatively or additionally still, the preload control signal 332 may decrease with increasing target engine speed 330 at constant hydraulic pressure.

Thus, the preload gain module 302 acts to send a minimum threshold control signal to the hydraulic pump assembly for operating conditions of relatively low target engine speed, relatively low pump discharge hydraulic pressure, or combinations thereof, to promote responsiveness of the hydraulic pump actuators 250, 252. It will be appreciated that other relationships among the same or other control inputs may be applied to determine the preload control signal 332 to suit the needs of other applications without departing from the scope of the present disclosure. Process 450 ends at step 462.

Referring to FIG. 3, the applicants identified advantages to reducing a load of the hydraulic pump assembly 127 when a temperature of the hydraulic system 150 or a temperature of the engine 126 exceeds a high threshold temperature, when a temperature of the hydraulic system 150 or a temperature of the engine 126 falls below a low temperature threshold, or a combination thereof. For example, at relatively low temperatures the viscosity of the hydraulic fluid in the hydraulic system 150 may increase, and therefore the hydraulic pump assembly 127 may impose a higher load on the engine 126 to pump the same flow rate of hydraulic fluid at a higher temperature. Accordingly, the machine 100 may benefit from limiting a load of the hydraulic pump assembly 127 when temperatures are below a low threshold temperature.

Relatively high temperatures sensed in the engine 126 or the hydraulic system 150 may be indicative of conditions that could limit the useful life of the engine 126, the hydraulic system 150, any components thereof, or combinations thereof. Thus, applicants identified advantages to limiting a load of the hydraulic pump assembly 127 when temperatures are above a high threshold to help decrease temperatures in the engine 126, the hydraulic system 150, or both, toward more desirable values.

Figure 7:
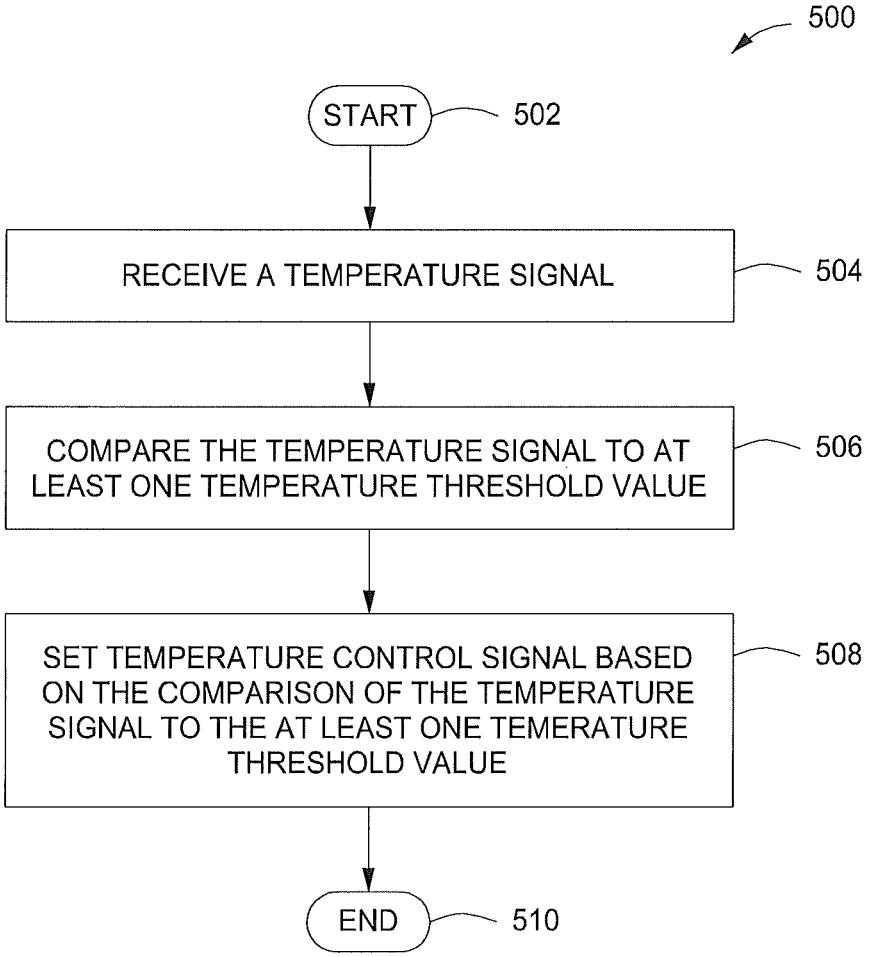
FIG. 7 is a flowchart for a process of a temperature gain module, according to an aspect of the disclosure.

FIG. 7 is a flowchart of a process 500 for a temperature gain module 304, according to an aspect of the disclosure. The process 500 begins in step 502. In step 504 the temperature gain module 304 receives at least one temperature signal. The at least one temperature signal may be indicative of a temperature of the engine 126, a temperature of the hydraulic system 150, or combinations thereof. According to an aspect of the disclosure the at least one temperature signal originates from the engine temperature sensor 170. According to another aspect of the disclosure, the at least one temperature signal originates from the hydraulic temperature sensor 171. According to yet another aspect of the disclosure, the temperature signal may be an arithmetic combination of multiple temperature signals, including an average or a weighted average of multiple temperature signals, for example.

In Step 506, the temperature gain module 304 compares the temperature signal to at least one temperature threshold. The at least one temperature threshold may include a first high temperature threshold, a second high temperature threshold being greater than the first high temperature threshold, a first low temperature threshold, a second low temperature threshold being lower than the first low temperature threshold, or combinations thereof.

In step 508, the temperature gain module 304 sets the temperature control signal 336 based on comparison of the temperature signal to the at least one temperature threshold values. According to an aspect of the disclosure, the temperature gain module 304 increases the temperature control signal 336 by a first amount when the temperature signal rises above the first high temperature threshold or drops below the first low temperature threshold. Additionally, the temperature gain module 304 may increase the temperature control signal 336 by a second amount that is greater than the first amount when the temperature signal rises above the second high temperature threshold or drops below the second low temperature threshold. Thus, the temperature gain module 304 may act to decrease a load applied to the engine 126 by the hydraulic pump assembly 127 when temperatures of the engine 126, the hydraulic system 150, or both, approach either extremely high or low values.

The temperature gain module 304 may vary the temperature control signal 336 in a stepwise fashion in response to temperature threshold triggers. Alternatively or additionally, the temperature gain module 304 may vary the temperature control signal 336 along a continuous function of the input temperature signal value, the continuous function being embodied in one or more mathematical relations, a lookup table, a physics-based model, combinations thereof, or any other continuous function model known in the art.

Non-limiting examples of first high temperature threshold and the second high temperature threshold may be 200 degrees Fahrenheit (93 degrees Celsius) and 212 degrees Fahrenheit (100 degrees Celsius), respectively, according to an aspect of the disclosure. Non-limiting examples of the first low temperature threshold and the second low temperature threshold may be 50 degrees Fahrenheit (10 degrees Celsius) and 2 degrees Fahrenheit (−17 degrees Celsius), respectively, according to an aspect of the disclosure. However, it will be appreciated that other threshold values or threshold value schemes may be applied to suit other applications without departing from the scope of the present disclosure. The process 500 ends at step 510.

When the engine 126 is highly loaded by the hydraulic system 150, such that the measured engine speed is near or below a target lug speed 308, the closed-loop gain module 300 may prevent the engine from stalling by selectively reducing a load applied to the engine 126 by the hydraulic pump assembly 127. Further, during such a lugging condition, the engine speed governor 158 (see FIG. 2) may cause the fuel system 160 to deliver a high flow rate of fuel to the engine 126 in an effort to decrease the error between the target engine speed and the lower engine speed during the lugging event.

Upon rapid unloading of the engine 126 from a lugging condition, for example, by control input from the operator via a control interface device 111, the load on the engine 126 may decrease faster than the fuel command signal from the engine speed governor 158 decreases, and therefore the unloading may result in overshooting the target engine speed. Applicants identified that adjusting the target engine speed in the engine speed governor 158 to a lower value during lugging events according to a throttle drop algorithm may help to reduce overshoot in engine speed when the engine 126 is unloaded from a lugging event.

Figure 8:
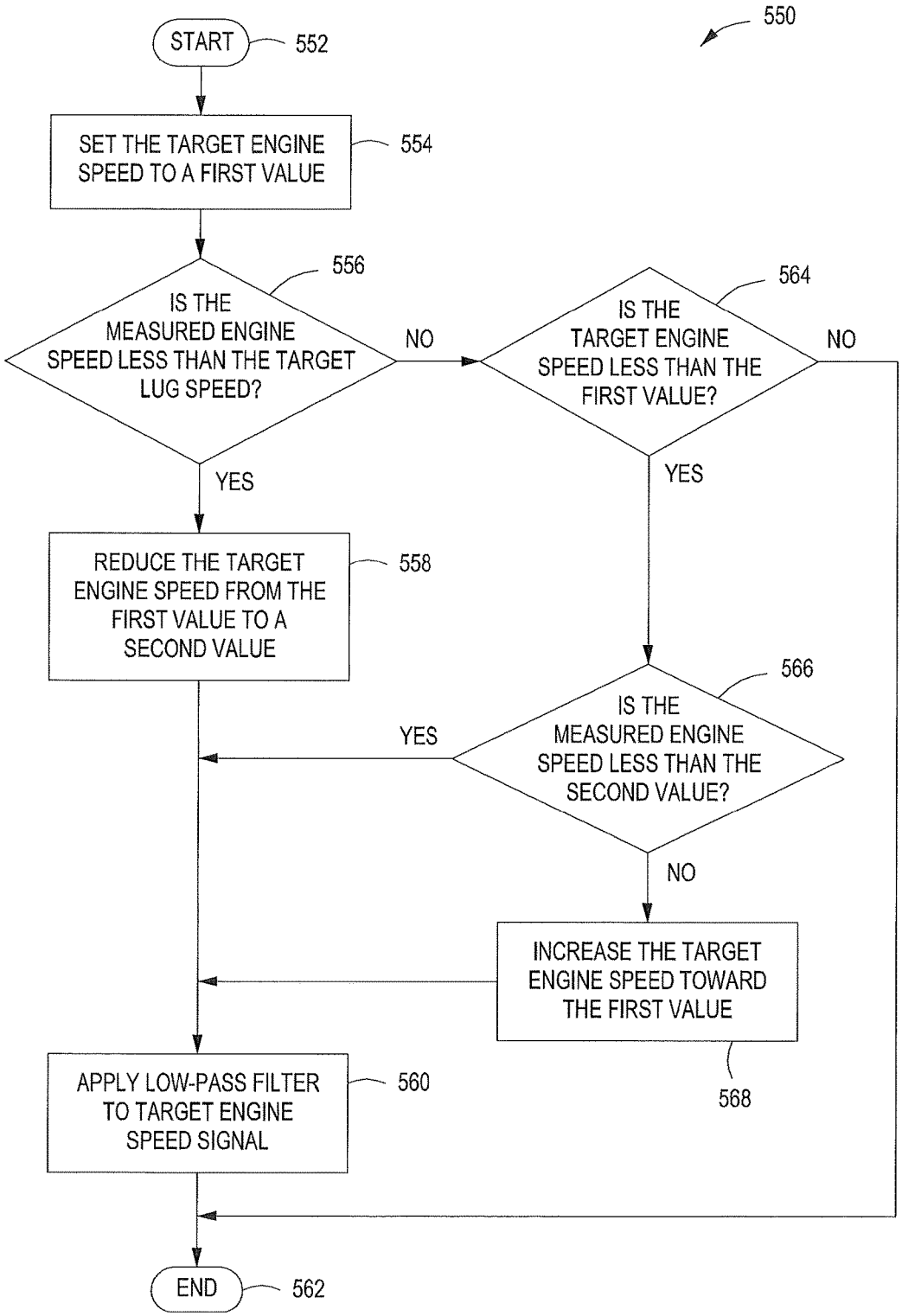
FIG. 8 is a flowchart for a process of a throttle drop module, according to an aspect of the disclosure.

FIG. 8 is a flowchart of a process 550 for a throttle drop module 164, according to an aspect of the disclosure. The process 550 starts at step 552. In step 554, the target engine speed may optionally be set to a first value, to initiate a starting value for the target engine speed. For example, the target engine speed may be set by input from an operator via a control interface device 111, or the target engine speed may assume a default value equal to the first value. Alternatively, during subsequent repetitions of the process 550, step 554 may be skipped. According to an aspect of the disclosure, the first value may correspond to a normal, high-idle operating speed of the engine 126, which in some applications may be near 2100 rpm.

In step 556, the throttle drop module 164 determines whether a measured engine speed is less than a target lug speed 308. If the measured engine speed is less than the target lug speed 308, indicating the engine 126 is operating in a highly-loaded, lugged state, then the process 550 proceeds to step 558 where the throttle drop module 164 reduces the target engine speed from the first value to a second value.

According to an aspect of the disclosure, the second value is less than the first value and greater than the target lug speed 308. According to another aspect of the disclosure the second value for the target engine speed is determined as the target lug speed 308 plus a speed offset. In one non-limiting example, the first speed may be near 2100 rpm, the target lug speed may be near 1950 rpm, and the speed offset may be near 50 rpm. Therefore, if the measured engine speed dropped below 1950 rpm, then the throttle drop module 164 would cause a decrease in the target engine speed from 2100 rpm to 2000 rpm (1950+50).

Therefore, if the engine 126 were abruptly unloaded after step 558, the speed error sensed by the engine speed governor 158 would approximately be the difference between the second target engine speed value and the target lug speed 308, which is smaller than the difference between the first target engine speed value and the target lug speed 308. As a result, the measured engine speed would be less likely to overshoot the first value of target engine speed because the engine speed governor may be commanding a lower fuel flow to reconcile the smaller speed error between the second target engine speed and the target lug speed 308.

Next, the process 550 proceeds to step 560, where a low-pass filter is optionally applied to the target engine speed signal, and then the process 550 ends at step 562.

If the measured engine speed is not less than the target lug speed in step 556, then the process 550 proceeds to step 564, where the throttle drop module 164 determines whether the current target engine speed is less than the first target engine speed value. If the target engine speed is less than the first target engine speed value, then the process 550 proceeds to step 566, where the throttle drop module 164 determines whether the engine speed is less than the second target engine speed value. If the measured engine speed is less than the second target engine speed value in step 566, then there is no need to adjust the target engine speed and the process 550 proceeds to step 560 and ends at step 562.

If the measured engine speed is not less than the second target engine speed value in step 566, then the process 550 proceeds to step 568, where the target engine speed is increased toward the first target engine speed value. In step 568, the target engine speed may be increased in a step-wise fashion, or the target engine speed may be increased gradually toward the first target engine speed value. According to an aspect of the disclosure, the low-pass filter in step 560 may promote a gradual increase in the target engine speed value from the second value to the first value. Alternatively, the throttle drop module 164 may define other schedules for increasing the target engine speed from the second value to the first value over time via step 568, including but not limited to, linear schedules, polynomial schedules, stair-step schedules, spline-based schedules, or any other schedule known in the art for gradually increasing a control parameter from a first value to a second value over time.

Accordingly, the throttle drop module 164 may help to limit engine speed overshoot upon rapid unloading of the engine operating near the target lug speed by decreasing the target engine speed from a first value to a second value when the engine 126 begins to operate in a highly-loaded, lugged state, and then increasing the target engine speed back to the first value after the measured engine speed increases above the second target lug speed value.

Referring to FIG. 2, the engine speed governor 158 may include an automatic idle adjustment module 166 that is configured to reduce a target engine speed for the machine 100 following periods of inactivity, according to an aspect of the disclosure. The automatic idle adjustment module 166 is configured to sense control inputs, for example, from a control interface device 111; sense changes in loads on any of the actuators in the implement system 102, the travel system 106, or any other machine system configured to perform work on a load; or combinations thereof, and the automatic idle adjustment module 166 is further configured to initiate upon sensing a control input or a change in a load.

The automatic idle adjustment module 166 is further configured to reduce the target engine speed for the engine 126 from a first value to a second value when the timer reaches a first threshold time. The automatic idle adjustment module 166 may be further configured to reduce the target engine speed from the second value to a third value when the timer reaches a second threshold time, where the second threshold time is greater than the first threshold time.

In a non-limiting example, the automatic idle adjustment module 166 is configured to decrease the target engine speed from 2100 rpm, or other high-idle set point, to 1800 rpm upon the timer reaching 5 seconds without detecting a control input or a change in a load on the machine 100. In addition, the automatic idle adjustment module 166 may be further configured to decrease the target engine speed from 1800 rpm to 800 rpm upon the timer reaching 10 seconds without detecting a control input or a change in load on the machine 100. As a result, decreasing the target engine speed during periods of activity may help operators save fuel, promote ergonomics of the operator station 110 by reducing the sound level of the machine 100 during inactivity, or combinations thereof.

The automatic idle adjustment module 166 may be further configured to return the target engine speed to the first, normal high-idle value, upon detecting a control input to the machine 100, for example through a control interface device 111, or by manual override of the target engine speed by the operator. According to an aspect of the disclosure, the automatic idle adjustment module 166 does not return the target engine speed to the first, normal high-idle value via control input to the control interface device 111, unless simultaneous actuation of one or more buttons on the control interface device 111 is detected.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A hydraulic system, comprising:

an engine;

at least one hydraulic pump operatively coupled to the engine for transfer of mechanical power therebetween; and a controller operatively coupled to the engine and the at least one hydraulic pump, the controller being configured to determine a lug speed error as a difference between a target lug speed value and a speed of the engine, set at least one closed-loop gain to zero when the speed of the engine is greater than or equal to the target lug speed value, set the at least one closed-loop gain to a non-zero value when the speed of the engine is less than the target lug speed value, generate a pump control signal by scaling the lug speed error by the at least one closed-loop gain, receive a first pressure signal based on a discharge pressure of the at least one hydraulic pump, generate a first open-loop signal based at least in part on the first pressure signal and a target engine speed value, superimpose the first open-loop signal with the pump control signal to generate a superimposed pump control signal, and transmit the superimposed pump control signal to the at least one hydraulic pump for controlling a load applied to the engine by the at least one hydraulic pump.

2. The hydraulic system of claim 1, wherein the scaling the lug speed error by the at least one closed-loop gain includes generating an integrated lug speed error value by integrating the lug speed error with time, and scaling the integrated lug speed error value by an integral closed-loop gain.

3. The hydraulic system of claim 2, wherein the controller is further configured to set the at least one closed-loop gain to zero when the speed of the engine increases above a sum of the target lug speed value and a first speed offset value.

4. The hydraulic system of claim 2, wherein the controller is further configured to set the at least one closed-loop gain to zero when the speed of the engine increases above the lesser of the target lug speed value plus a first speed offset value, and a target engine speed minus a second speed offset value, the target engine speed minus the second speed offset value being greater than the target lug speed value.

5. The hydraulic system of claim 1, wherein the scaling the lug speed error by the at least one closed-loop gain includes scaling the lug speed error by a proportional closed-loop gain.

6. The hydraulic system of claim 1, wherein the at least one hydraulic pump includes a first hydraulic pump and a second hydraulic pump, and the first pressure signal is based on a discharge pressure of the first hydraulic pump, the controller being further configured to receive a second pressure signal based on a discharge pressure of the second hydraulic pump, and generate the first open-loop signal based on an average of the first pressure signal and the second pressure signal.

7. The hydraulic system of claim 6, wherein the controller is further configured to apply a low-pass filter to the average of the first pressure signal and the second pressure signal.

8. The hydraulic system of claim 1, wherein the controller is further configured to increase the at least one closed-loop gain with increasing lug speed error.

9. The hydraulic system of claim 1, wherein the controller is further configured to receive a temperature signal, the temperature signal being indicative of at least one of a temperature of the engine, and a temperature of the at least one hydraulic pump, and a temperature of a hydraulic fluid within the hydraulic system, generate a second open-loop signal based on the temperature signal, and superimpose the second open-loop signal with the pump control signal.

10. The hydraulic system of claim 1, wherein the non-zero value of the at least one closed-loop gain is selected from a plurality of non-zero values that increase monotonically as a function of the lug speed error.

11. The hydraulic system of claim 1, wherein the controller is further configured to decrease an engine speed command signal from a first value to a second value when the speed of the engine decreases below the target lug speed value, the second value being greater than the target lug speed value, and increase the engine speed command signal from the second value to a third value when the speed of the engine increases above the target lug speed value.

12. The hydraulic system of claim 11, wherein the controller is further configured to increase the engine speed command signal from the second value to the third value when the speed of the engine increases above the second value.

13. The hydraulic system of claim 11, wherein the third value equals the first value.

14. The hydraulic system of claim 1, wherein a load of the at least one hydraulic pump is configured to vary inversely with a magnitude of the pump control signal.

15. The hydraulic system of claim 1, wherein the at least one closed-loop gain includes a plurality of closed-loop gains, and wherein the controller is further configured to set each closed-loop gain of the plurality of closed-loop gains to zero when the speed of the engine is greater than or equal to the target lug speed value.

16. A method for controlling a hydraulic system, comprising:

transmitting mechanical power from an engine to at least one hydraulic pump;

determining a lug speed error as a difference between a target lug speed value and a speed of the engine;

setting at least one closed-loop gain to zero when the speed of the engine is greater than or equal to the target lug speed value;

setting the at least one closed-loop gain to a non-zero value when the speed of the engine is less than the target lug speed value;

generating a pump control signal by scaling the lug speed error by the at least one closed-loop gain;

receiving a first pressure signal based on a discharge pressure of the at least one hydraulic pump, generating a first open-loop signal based at least in part on the first pressure signal and a target engine speed value, superimposing the first open-loop signal with the pump control signal to generate a superimposed pump control signal, and transmitting the superimposed pump control signal to the at least one hydraulic pump for controlling a load applied to the engine by the at least one hydraulic pump.

17. An article of manufacture comprising non-transient machine-readable instructions encoded thereon for causing a processor to control a hydraulic system by performing process steps, the hydraulic system including at least one hydraulic pump, the process steps including:

determining a lug speed error as a difference between a target lug speed value and a speed of an engine, setting at least one closed-loop gain to zero when the speed of the engine is greater than or equal to the target lug speed value, setting the at least one closed-loop gain to a non-zero value when the speed of the engine is less than the target lug speed value, generating a pump control signal by scaling the lug speed error by the at least one closed-loop gain, receiving a first pressure signal based on a discharge pressure of the at least one hydraulic pump, generating a first open-loop signal based at least in part on the first pressure signal and a target engine speed value, superimposing the first open-loop signal with the pump control signal to generate a superimposed pump control signal, and transmitting the superimposed pump control signal to the at least one hydraulic pump for controlling a load applied to the engine by the at least one hydraulic pump.

* * * * *